United States Patent [19]

Snitman

[11] Patent Number: 4,619,084

[45] Date of Patent: Oct. 28, 1986

[54] ARTICULATING, SELF-SUPPORTING STAIRCASE

[76] Inventor: Bernard H. Snitman, 21 Tyrrel Avenue, Toronto, Ontario, Canada, M6G 2G1

[21] Appl. No.: 695,825

[22] Filed: Jan. 28, 1985

[51] Int. Cl.[4] ..... E04F 11/00

[52] U.S. Cl. ..... 52/182; 52/187; 182/178; 182/194; 403/297

[58] Field of Search ..... 52/187, 188, 189, 190, 52/183, 182; 182/178, 228, 194; 403/248, 297, 358, 353

[56] References Cited

U.S. PATENT DOCUMENTS

| | | | |
|---|---|---|---|
| 3,473,275 | 10/1969 | Lappin | 52/187 |
| 3,908,325 | 9/1975 | Kenngott | 52/188 |
| 3,916,591 | 11/1975 | Agterhof et al. | 52/187 |
| 3,964,222 | 6/1976 | Geleijnse et al. | 52/187 |
| 4,285,517 | 8/1981 | Holzkämpfer et al. | 52/187 |
| 4,296,577 | 10/1981 | Schuette | 52/187 |
| 4,373,609 | 2/1983 | De Donato | 52/187 X |
| 4,464,076 | 8/1984 | Leibhard | 403/297 |
| 4,481,702 | 11/1984 | Mitchell | 403/297 X |

FOREIGN PATENT DOCUMENTS

| | | | |
|---|---|---|---|
| 1005964 | 3/1977 | Canada . | |
| 106125 | 4/1984 | European Pat. Off. | 52/182 |
| 2129753 | 12/1972 | Fed. Rep. of Germany | 182/194 |
| 2552220 | 6/1977 | Fed. Rep. of Germany . | |
| 2268918 | 11/1975 | France | 52/187 |
| 1455924 | 11/1976 | United Kingdom | 52/187 |

*Primary Examiner*—William F. Pate, III
*Assistant Examiner*—Jean M. Lakemper
*Attorney, Agent, or Firm*—Riches, McKenzie & Herbert

[57] ABSTRACT

A stairway construction, specifically, an articulating self-supporting staircase. The staircase comprises a plurality of individual, interconnected elements, each element having a tread and a riser. A new wedge locking means to lock the interconnected elements firmly together is disclosed. This construction allows for a variety of widths, materials and layouts of the elements and is sufficiently strong to comply with building codes yet is light weight and easy to install in a variety of configurations. Modularity of assembly and ease of construction is achieved which provides an improvemenmt over the prior art.

13 Claims, 7 Drawing Figures

ARTICULATING, SELF-SUPPORTING STAIRCASE

BACKGROUND OF THE INVENTION

1. Field of the Invention

This invention relates generally to a stairway construction and more particularly, to a novel stairway construction which consists of a plurality of elements which interconnect to form an articulating, self-supporting staircase.

2. Description of the Prior Art

It has been previously proposed to provide a stairway construction which consists of a plurality of stairway support elements, each element having a horizontal portion on which is mounted the stairway tread, and a vertical portion, which extends upwardly from the horizontal portion to interconnect with the element immediately above and which extends downwardly from the horizontal portion to interconnect with the element immediately below.

The most difficult problem encountered with these structures is to provide a self-supporting structure which is safe and secure. Each element must be secured to the adjacent element immediately above and immediately below in such a manner to ensure safety, yet such construction must be simple and easy to install on site with minimal time and tools being required. The structure must be designed to be economical yet aesthetically pleasing and must have the adaptability to be fully adjustable in height and in orientation. Space and size restrictions must be able to be accommodated for all possible installations.

The first attempt to provide such structures utilized a central column to which riser and tread members were attached. An example of such a structure is shown in U.S. Pat. No. 3,964,222 granted on June 22, 1976 to Geleijnse et al. Reference is also made to U.S. Pat. No. 3,916,591 granted on Nov. 4, 1975 to Agterhaf et al. which uses a spindle to which the steps are attached.

Free standing stairway constructions have also been attempted in the past. One such example is shown in U.S. Pat. No. 3,473,275 granted on Oct. 21, 1969 to Lappin which shows a stairway comprising a series of individual stair tread units, each connected by fasteners such as bolts or screws to each others. Other more recent constructions are shown in German Offenlegungsschrift No. 25 52 220 and German Offenlegungsschrift No. 2 129 753, U.S. Pat. Nos. 3,908,325; 4,285,178, and Canadian Pat. No. 1,005,964.

The principle concern of these patents and the inventions disclosed herein reside in the problem of securing the elements together in such a manner to provide a safe and secure structure which will not fatique over time. For example, Canadian Pat. No. 1,005,964 discloses a structure which uses telescopically interengageable metallic tubes as the vertical portions with bearing members to clamp the tubes together. Steel balls are used about the bearing members to increase the clamping effect.

Various forms of clamps and bolts have also been tried to prevent sagging of the structure over time. However, it has been found that all these structures will fatigue over time and fail to meet the building codes of many jurisdictions.

SUMMARY OF THE INVENTION

Accordingly, it is an object of the present invention to at least partially overcome these disadvantages by providing a novel stairway construction which consists of a plurality of elements, each element supporting a step, which construction allows for a variety of widths, materials and layouts of the elements. The construction is sufficiently strong to comply with building codes and yet is lightweight and easy to install in a variety of configurations. Modularity of assembly and ease of construction in any size or shape is achieved with the present structure. The structure, when assembled, forms an articulating, self supporting staircase.

To this end, in one of its aspects, the invention provides an articulating, self supporting staircase which comprises a plurality of individual, interconnected elements, each element having a tread and a riser, and a wedge locking means to lock said interconnected elements firmly together.

In another of its aspects, the invention further provides an articulating, self-supporting staircase which comprises a plurality of individual, interconnected elements, each element having a tread and a riser, and a wedge locking means to lock said interconnected elements fully together, wherein each tread is secured to the top of each riser by means of a plurality of screws, each screw extending upwardly through a boss in said riser, into said tread; each riser except the top riser having a conical protrusion extending upwardly from the rear of a base, said base having a plurality of strengthening ribs therein and a strengthening box therein which is enclosed by a plate, said base having a tapering hole on the surface at the front thereof which hole is adapted to receive and retain the protrusion of the lower adjacent element, each protrusion having three longitudinally slotted flattened sides; said wedge locking means comprising three longitudinally ribbed wedges, each wedge adapted to slide over one of said flattened sides of said protrusion, a retaining ring adapted to retain said wedge on said flattened sides, and a threaded bolt adapted to be inserted through said hole and into the protrusion of the riser to interconnect said adjacent riser, and a washer on said bolt above said wedges on the lower protrusion, whereby when said bolt is tightened, said washer drives said wedge downwardly and firmly interconnects adjacent risers.

Further objects and advantages of the invention will appear from the following description taken together with the accompanying drawings.

DESCRIPTION OF THE PREFERRED EMBODIMENT

Figure 1:
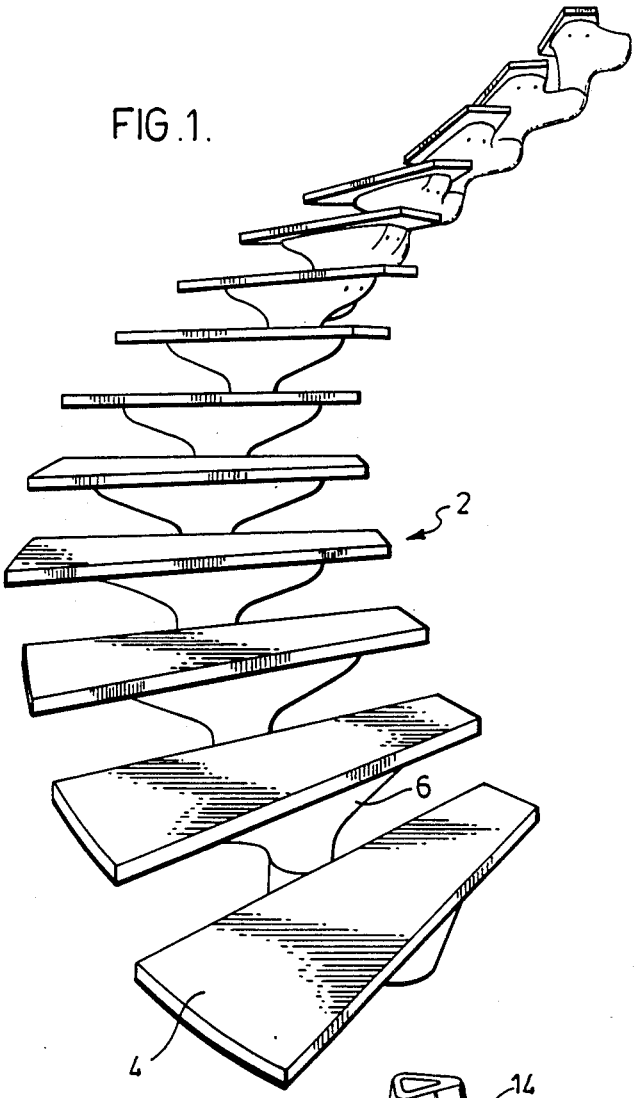
FIG. 1 is a perspective view of the assembled stairway construction of the present invention.

Referring now to the drawings and in particular, to FIG. 1, the assembled stairway construction of the present invention comprises a plurality of elements 2 secured together to form an articulating, self-supporting staircase.

Figure 3:
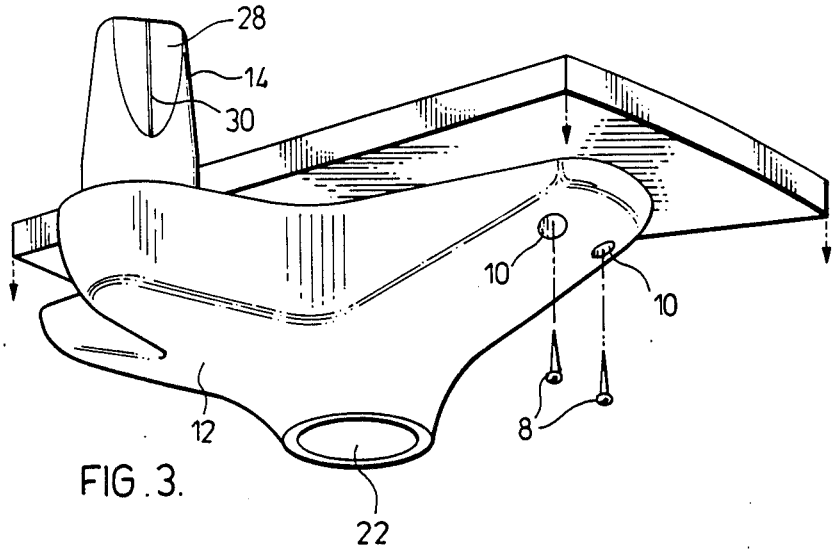
FIG. 3 is an exploded, bottom perspective view of a riser and a tread of the present invention.
Figure 4:
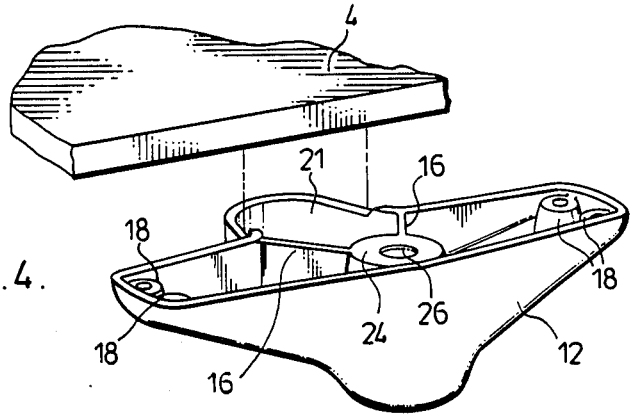
FIG. 4 is an exploded view of the top riser and a part of the tread of the present invention.

Each element comprises a tread 4 and a riser 6. The tread 4 is generally rectangular although variations may be made within the scope of this invention. The tread 4 is secured to the riser 6 by any suitable means. As shown in FIGS. 3 and 4, one such means includes screws 8 which are inserted through holes 10 in the undersurface of the riser 6. The screws 8 extend through the bosses 18 (see FIG. 4) and into corresponding holes (not shown) in the bottom of the tread 4. The screws 8 are then tightened which pulls the tread 4 into contact with the riser 6. Any desired decorative covering may be placed on the top surface of the tread 4.

Figure 2:
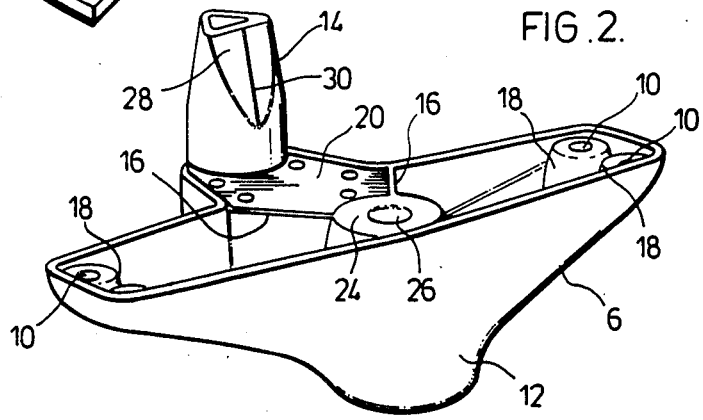
FIG. 2 is a front perspective view of a riser of the present invention.

The riser 6 as shown in FIG. 2, comprises a base 12 and a conical protrusion 14. The base 12 has been cast in a particularly aesthetically pleasing shape but may be made of any desired shape or outline as desired, within the range of the present invention. The base 12 has been hollowed out to reduce its weight and to reduce its costs of manufacture. However, to impart the necessary strength to the structure, ribs 16 are provided. Bosses 18 are provided, preferably four in number, through which screws 8 extend to retain the tread 4 in the desired position.

The ribs 16, in conjunction with the side walls of the base 12, form a box-like structure as best seen in FIG. 2. Plate 20 is provided which is secured by screws 46 into bosses 44 to increase the strength of the base 12. A tapered opening 22 is provided in the forward bottom portion of the base 12 which will accommodate the conical protrusion 14 of the adjacent riser 6, as will be explained hereinafter. The tapered opening 22 extends into an enlarged, recessed, boss 24 to which ribs 16 are joined. Hole 26 is provided in the top of the boss 24, the purpose of which will be explained hereinafter.

Figure 5:
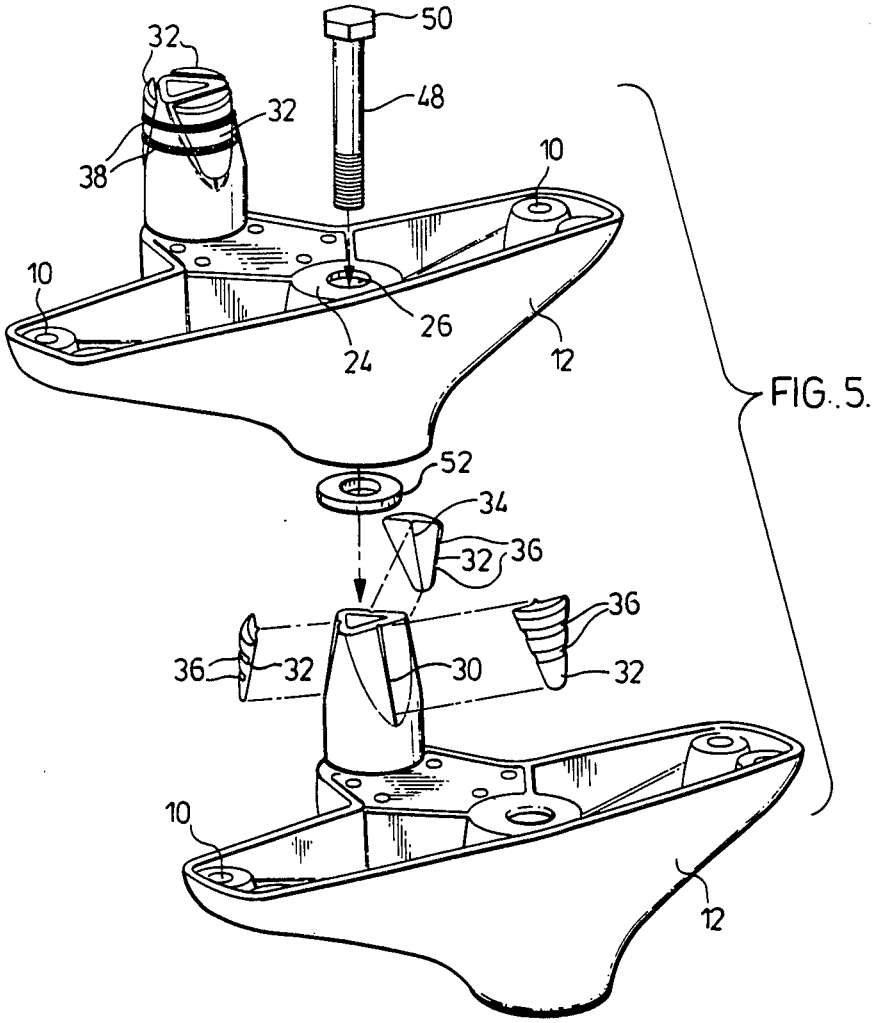
FIG. 5 is an exploded view of two risers and the means to lock two risers together.

The conical protrusion 14 extends upwardly from the rear of the base 12 and the top surface is truncated. The protrusion 14 is flattened on three sides as shown in FIG. 5 . While the preferred embodiment has three flattened sides 28, the invention is not so restricted and will be operative with one or more flat sides. Each of the flat sides 28 has a longitudinal slot 30 cut therein.

FIG. 5 illustrates the wedge locking means which is used to lock two risers together. Three wedges 32 are provided and each wedge 32 is contoured to mate with the inside tapered wall of the opening 22 as will be explained hereinafter. Each wedge 32 has a rib 34 extending along its length and the rib 34 is constructed to fit within the slot 30 on each flattened side of the protrusion 14. Retaining rings 38 (or any similar means such as retaining clips) fit into transverse grooves 36 around each wedge 32. Thus as shown in FIG. 5 in the assembled position, the interaction between rib 34 and slot 30 only allows vertical movement of the wedge 32.

A large, threaded bolt 48 is provided with a hex head 50 which is adapted to fit through the hole 26 in the boss 24. A large washer 52 is placed on the bolt 48 between the top of the conical protrusion 14 of the underneath riser 6.

As shown in FIG. 4, the top riser 12 does not have a conical protrusion and the tread 4 extends over the surface of the riser 6. In the case of the top riser 12, the plate covers the entire box 21 as shown in FIG. 4.

Figure 6:
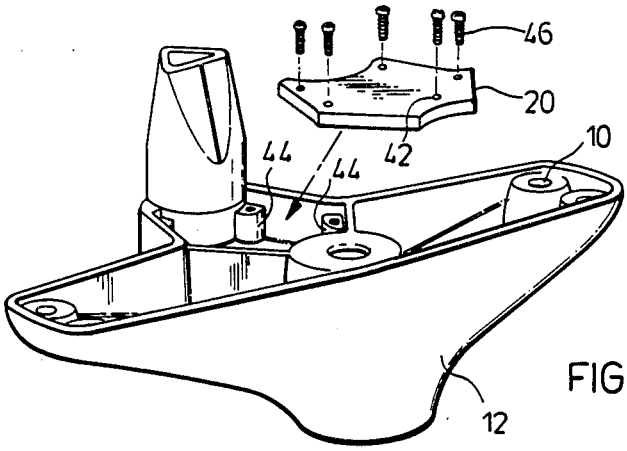
FIG. 6 is an exploded view of a view of FIG. 2.

The assembly of the novel stairway construction will now be explained. The first step is to assemble the plate 20 on each riser 6. The plate 20 as shown in FIG. 6, is orientated correctly and secured to the riser as shown in FIG. 2. Screws 46 are secured through the hole 42 and inserted into the bosses 44. Since the bosses 44 are below the planar surface of the riser, the plate 20 sits inside the thus formed box thereby providing a smooth top surface as shown in FIG. 2.

The wedges 32 are then each placed on a flattened surface 28 of the conical protrusion 14 such that the rib 34 is keyed into the slot 30. The retaining rings 38 are placed over the wedges 32 to secure the wedges in place. The bolt 48 is then inserted through hole 26 in boss 24 and washer 52 is placed on the end of the bolt 48 which emerges through the hole 22. The end of the bolt is then inserted into the top hole of the conical protrusion 14.

Figure 7:
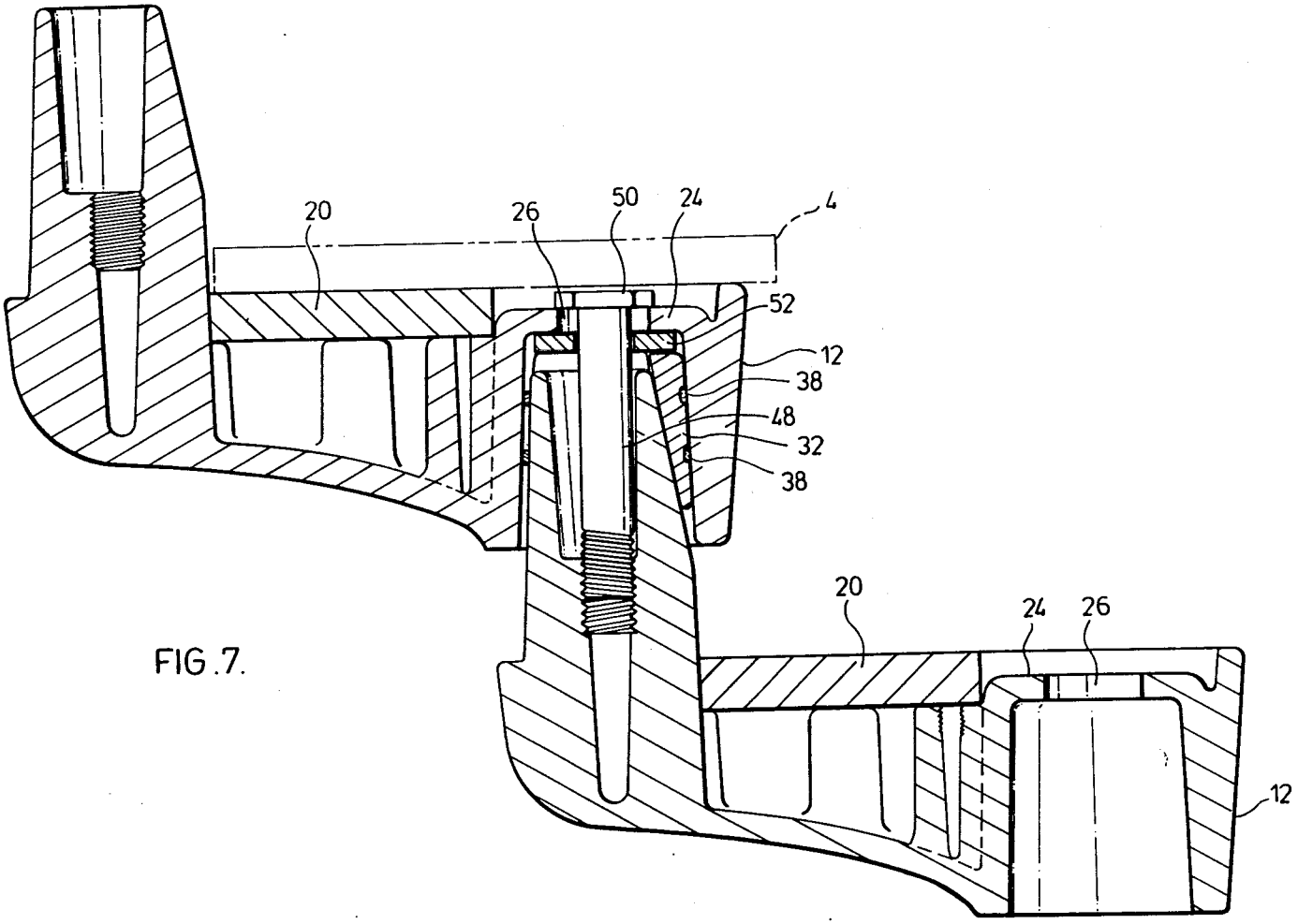
FIG. 7 is a cross sectional view of two assembled risers and treads of the present invention.

The conical protrusion 14 of the lower riser is then inserted into hole 22 of the upper riser as shown in FIG. 7. The orientation and rise of each riser is then adjusted and the bolt 48 is tightened. This action drives the wedges downwardly along the key lined walls of the conical section by the action of the washer and the retaining rings 38 permit the necessary expansion to occur. The process is then repeated for all the desired risers. Treads 4 are then secured to the top of each riser.

The stairway construction provides a very secure and strong free-standing, self-supporting structure. The riser is preferably of cast aluminum, or any other material which possesses sufficient inherent strength and is quite easy to cast. Most of the prior art devices were found to be too brittle and not suitable. The aluminum 356 alloy does not suffer from fatigue over time.

The particular wedge locking system of the present invention provides notable improvements over the prior art. Since the wedges, preferably cast of maleable iron, are key lined to mate with the flattened surface of the conical protrusion, they do not and cannot move laterally. The wedges, as shown in FIG. 7, are contoured to mate with the inside tapered walls of the opening at the lower front of the adjacent casting. Once the wedges are in place and the orientation of the risers is set, the bolt is tightened which drives the wedges downwardly. A noted advantage of this structure is that continued strengthening of the wedge lock system occurs through use of the staircase. As weight is applied to the tread by persons mounting the staircase, pressure is applied which tends to tighten the wedge fit.

The present construction also provides for many advantages over the prior art. It allows for full variability of riser height within the normal range of staircase construction requirements. By adjusting the height of the wedges and by tightening the bolt, the height between adjacent risers may be controlled thereby allowing for more variability in the height of the risers.

The device also allows for rotational adjustment of the risers. The conical protrusion of each riser may be adjusted rotationally within the opening of the upper riser before tightening. Therefore, by making such an adjustment, the orientation of the "spinal column" shown in FIG. 1 may be completely adjusted for a straight line, a tight turn, a wide turn or any variation in between. Also, identical curves may be produced between respective risers if desired.

Maximum strength of the construction is also achieved by use of the box structure and the plate on each riser. This has been found to be sufficient to meet building codes in all jurisdictions.

The construction is also easily assembled on site using a minimum number of tools and expertise. Simple construction and assembly provides a notable advantage over the prior art.

The inventor has constructed a stairway according to the present invention and has subjected it to various tests. The stairway was made of ALMAG 35 (Alcon alloy 535.2) (trade mark) and had sufficient strength, castability and finishing options.

Four basic tests were applied to the stairway. These tests were as follows:

Test 1: load test on a simple element to determine bending strength.

Test 2: load test on two attached elements to determine bending strength of the box section.

Test 3: same as test 2 but load applied to edge of element.

Test 4: load tests on a stairway consisting of 14 elements by applying an equal load to each element in sequence from step 2 to 12.

The loads on tests 1, 2 and 3 were applied with a hydraulic jack and recorded via a 10,000 lb load cell. In test 4, each step was loaded with a deadweight of 838 lb (380 kg) and the deflection was measured on every second step. For a final test, the maximum load was determined by loading the weakest point in the structure (step 7) until breakage occurred.

Two load applications were done in test 1. The first used 4300 lbs and the second used 4800 lbs. A physical inspection revealed no signs of failure, i.e. no cracks on any part of the element.

Test 2 used a bond applied in the mounting point of the element using a maximum load of 2700 lbs. Test 3 used the same maximum load on the edge of each element. No physical sign of failure on any part of the elements or attachment points occurred.

For test 4, deflection readings were taken on the outside edge of the steps and the results are shown in Table 1. For the maximum load test, step 7 was loaded to 2650 lbs when breakage occurred in step 1.

TABLE 1

Deflection Chart

Underlined deflection reading designates loads step deflection readings in inches

| Deflection on Step # | Before Test No Load | Load of 838 lbs. (380 kg) on Step # 2 | 3 | 4 | 5 | 6 | 7 | 8 | 9 | 10 | 11 | 12 | After Test No Load |
|---|---|---|---|---|---|---|---|---|---|---|---|---|---|
| 14 | Zero Deflection | 1/8 | 1/8 | 1/8 | 1/8 | 1/8 | 1/8 | 1/8 | 1/8 | 1/4 | 1/4 | 5/16 | Zero |
| 12 | Zero Deflection | 5/16 | 7/16 | 1/2 | 5/8 | 3/4 | 7/8 | 1 | 1 1/4 | 1 7/16 | 1 1/2 | 1 9/16 | 7/8 |
| 10 | Zero Deflection | 5/16 | 11/16 | 15/16 | 1 1/4 | 1 3/4 | 2 1/16 | 2 3/8 | 2 11/16 | 2 11/16 | 1 11/16 | 2 5/8 | 1 11/16 |
| 8 | Zero Deflection | 1/8 | 3/8 | 3/4 | 1 1/4 | 1 13/16 | 2 3/16 | 2 9/16 | 2 11/16 | 2 11/16 | 2 11/16 | 2 1/16 | 1 3/8 |
| 7 | Zero Deflection | 1/8 | 7/16 | 13/16 | 1 3/8 | 2 | 2 3/16 | 2 5/8 | 2 5/8 | 2 9/16 | 2 3/8 | 2 3/16 | 1 3/8 |
| 6 | Zero Deflection | 3/8 | 1/2 | 7/8 | 1 1/16 | 1 13/16 | 1 13/16 | 2 5/16 | 2 5/8 | 1 1/16 | 2 | 1 3/4 | 1 3/16 |
| 4 | Zero Deflection | Zero | 5/16 | 9/16 | 13/16 | 15/16 | 1 | 1 1/16 | 1 1/16 | 15/16 | 15/16 | 5/8 | 7/16 |
| 2 | Zero Deflection | 1/16 | 1/8 | 1/8 | 1/8 | 1/8 | 1/8 | 1/8 | 1/8 | 1/8 | 1/8 | 1/8 | Zero |

As shown by the test results, a very satisfactory product was produced which meets all building codes.

While the invention discloses and describes a preferred embodiment of the invention, it is to be understood that it is not so restricted.

What I claim is:

1. An articulating, self-supporting staircase which comprises a plurality of individual, interconnected and locked elements, each element having a tread and a riser, and a wedge locking means locking said interconnected elements firmly together, wherein each riser except for the top riser, comprises a base and a conical protusion extending upwardly from the rear of said base, each protrusion having at least one longitudinally slotted flattened side and wherein said wedge locking means comprises at least one longitudinally ribbed wedge over said flattened side of said protrusion, and a retaining ring retaining said at least one wedge on said at least one flattened side.

2. A staircase as claimed in claim 1 wherein a tread is secured to the top of the base of each riser by a securing means.

3. A staircase as claimed in claim 1 wherein a tread is secured to the top of the base of each riser by means of a plurality of screws, each screw extending upwardly through a boss in said base of each riser into said tread.

4. A staircase as claimed in claim 1 wherein said base has a plurality of strengthening ribs therein.

5. A staircase as claimed in claim 4 wherein said base further includes a strengthening box enclosed by a plate to impart additional strength to the base.

6. A staircase as claimed in claim 1 wherein said base has a hole on the undersurface at the front thereof, wherein the protrusion of the lower adjacent element is inserted and locked.

7. A staircase as claimed in claim 1 wherein each protrusion has three longitudinally slotted flattened sides.

8. A staircase as claimed in claim 7 wherein said wedge locking means comprises three longitudinally ribbed wedges, each wedge over one of said flattened sides of said protrusions and a retaining ring retaining said wedges on said flattened sides.

9. A staircase as claimed in claim 7 wherein the inner side walls of said base which form said hole are inwardly tapering and receive the protrusion of the riser thereunder.

10. A staircase as claimed in claim 6 further including a threaded bolt which is inserted through said hole and into the conical protrusion of the riser to interconnect said adjacent risers.

11. An articulating, self-supporting staircase which comprises a plurality of individual, interconnected and locked elements, each element having a tread and a riser, and a wedge locking means locking said interconnected elements firmly together, wherein each tread is secured to the top of each riser by means of a plurality of screws, each screw extending upwardly through a boss in said riser, into said tread; each riser except for the top riser comprising a base and a conical protrusion extending upwardly from the rear of said base, said base having a plurality of strengthening ribs therein, and a strengthening box therein which is enclosed by a plate, said base having a tapering hole on the undersurface at the front thereof wherein the protrusion of the lower adjacent element is inserted and locked, each protrusion having three longitudinally slotted flattened sides; said wedge locking means comprising three longitudinally ribbed wedges, each wedge over one of said flattened sides of said protrusions, a retaining ring retaining said wedges on said flattened sides, and a threaded bolt inserted through said hole and into the protrusion of the riser to interconnect said adjacent risers, and a washer on said bolt above said wedges on the top of said protrusions; whereby when said bolt is tightened, said washer drives said wedges downwardly and firmly interconnects adjacent risers.

12. A staircase as claimed in claim 11 wherein said risers are cast of an aluminum alloy.

13. A staircase as claimed in claim 11 wherein said wedges are cast of maleable iron.

* * * * *